US006283802B1

(12) United States Patent
Sato et al.

(10) Patent No.: US 6,283,802 B1
(45) Date of Patent: Sep. 4, 2001

(54) RECEPTACLE TERMINAL AND FORMING METHOD OF THE SAME

(75) Inventors: Naotoshi Sato; Kimihiro Abe, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/631,386

(22) Filed: Aug. 3, 2000

(30) Foreign Application Priority Data

Aug. 4, 1999 (JP) ..... 11-220777

(51) Int. Cl.[7] ..... H01R 4/48
(52) U.S. Cl. ..... 439/843
(58) Field of Search ..... 439/843, 851, 439/839, 845, 397, 852, 853

(56) References Cited

U.S. PATENT DOCUMENTS

| | | | | |
|---|---|---|---|---|
| 4,648,673 | * | 3/1987 | Endo et al. | 339/97 R |
| 5,186,664 | * | 2/1993 | Abe | 439/845 |
| 5,226,842 | * | 7/1993 | Endo et al. | 439/843 |
| 5,271,741 | * | 12/1993 | Saito et al. | 439/843 |
| 5,350,321 | * | 9/1994 | Takenouchi | 439/839 |
| 5,427,553 | * | 6/1995 | Tsuji | 439/851 |
| 5,433,629 | * | 7/1995 | Yagi et al. | 439/843 |
| 5,441,428 | * | 8/1995 | Hamai et al. | 439/843 |
| 5,536,186 | * | 7/1996 | Watanabe et al. | 439/843 |
| 5,554,046 | * | 9/1996 | Sugiyama et al. | 439/397 |
| 5,658,174 | * | 8/1997 | Benes et al. | 439/843 |
| 6,050,862 | * | 4/2000 | Ishii | 439/843 |

FOREIGN PATENT DOCUMENTS 64-10589 1/1989 (JP) .

* cited by examiner

*Primary Examiner*—Gary Paumen
*Assistant Examiner*—P. Nguyen
(74) *Attorney, Agent, or Firm*—Armstrong, Westerman, Hattori, McLeland & Naughton, LLP

(57) ABSTRACT

A base plate strip is formed with an extension which is forwardly extending from an electrical contact barrel. A groove is provided in the extension such that the groove is extending across a fore open end of the electrical contact barrel. A fore end extended piece of a resilient contact tongue strip overlies the extension of the base plate strip. The resilient contact tongue strip is cut together with the base plate strip along the fore open end of said electrical contact barrel. This defines a stepped surface in the base plate at the open periphery of the electrical contact barrel and defines an engagement end piece at the fore end of the resilient contact tongue. The engagement end piece engages with the stepped surface to prevent the resilient contact tongue from moving in the insertion direction of an associated pin terminal.

2 Claims, 3 Drawing Sheets

RECEPTACLE TERMINAL AND FORMING METHOD OF THE SAME

BACKGROUND OF THE INVENTION

1. Field of the Invention

The present invention relates to a receptacle terminal consisting of an electrical contact barrel and a resilient contact tongue arranged in the electrical contact barrel for receiving a pin terminal with a reliable contact force.

2. Related Art

A conventional receptacle terminal has a resilient contact tongue integrally formed with the terminal for contacting a side surface of an associated pin terminal. To increase the contacting force against the pin terminal, there have been proposed various types of receptacle terminals each accommodating a resilient contact tongue with a larger resiliency in an electrical contact barrel of the receptacle terminal.

FIG. 5 shows one of these receptacle terminals. The receptacle terminal has a base plate 13 formed with an electrical cable crimping barrel 12 at a rear portion thereof. The base plate 13 is also formed with an electrical contact barrel 11 for receiving a pin terminal (not shown) at a fore portion thereof. The electrical contact barrel 11 accommodates a curbed resilient contact tongue 17 to resiliently contact the pin terminal. The electrical contact barrel 11 has a pair of side walls 14 raised from the base plate 13 and also has a pair of top walls 15 each formed by inwardly bending each side wall, so that the electrical contact barrel 11 is defined. The resilient contact tongue 17 is provided with a pair of fore end tabs 18 each projecting laterally from the resilient contact tongue 17 at each side thereof. Each tab 18 is inserted into one of a pair of insertion openings 16 each formed in each sidewall 14 of the electrical contact barrel. Thereby, the resilient contact tongue 17 is retained in the electrical contact barrel 11 and can resiliently contact the pin terminal.

In the constitution shown in FIG. 5, the resilient contact tongue 17 has the tabs 18 at the fore end thereof to be inserted in the insertion openings 16. This causes a contact point (a bend peak) of the resilient contact tongue 17 to be positioned backward by the length of the tab, so that the associated pin terminal must have a pin having a longer length, which is disadvantageous for downsizing of a connector accommodating the receptacle terminal.

Therefore, the applicant of this patent application has proposed another receptacle terminal shown in Japanese Patent Application Laid-open No. 64-10589. This receptacle terminal, as illustrated in FIG. 6, has a resilient contact tongue 17 formed with a pair of tabs 18 each projecting from each side end of the resilient contact tongue 17. Each tab 18 is engagedly supported by an insertion opening 16 of each side wall 14 of an electrical contact barrel 11 constituting the receptacle terminal.

The receptacle terminal shown in FIG. 6 requires a clearance between the tab 18 and the periphery of the insertion opening 16 so that the resilient contact tongue 17 moves smoothly. In a state in which an associated pin terminal is not inserted, the resilient contact tongue 17 is normally positioned as illustrated in FIG. 7. However, in a state in which a pin terminal 21 is inserted, the resilient contact tongue 17 moves in the insertion direction of the pin terminal as illustrated in FIG. 8. Thereby, the tab 18 is abutting against a peripheral edge 19 of the insertion opening 16, preventing a free resilient movement of the resilient contact tongue 17. This causes a larger force for the pin terminal 21 to be inserted into the receptacle terminal.

SUMMARY OF THE INVENTION

Therefore, to eliminate such disadvantages, an object of the present invention is to provide a receptacle terminal and a forming method of the same. A resilient contact tongue 17 of the receptacle terminal does not move in the insertion direction of an associated pin terminal 21 during insertion of the pin terminal 21, so that the pin terminal 21 can be inserted without an additional force.

For achieving the object, a first aspect of the present invention is a receptacle terminal which includes a base plate, an electrical wire connection barrel formed in a rear portion of the base plate, a pair of side walls rising fran the base plate at a fore potion of the base plate, and a pair of top walls each extending from each of the side walls. Thus, the base plate, the side walls, and the top walls define an electrical contact barrel for receiving a pin terminal. The electrical contact barrel accommodates a resilient contact tongue having a pair of tabs each laterally projecting from the resilient contact tongue. The tabs each are inserted into and positioned in an insertion opening formed in each of the side walls of the electrical contact barrel so that the resilient contact tongue is retained in the electrical contact barrel. The electrical contact barrel has a stepped surface formed on an end piece of the base plate at an open end of the electrical contact barrel. The resilient contact tongue has an engagement end piece at least partially engaging with the stepped surface to prevent the resilient contact tongue from moving in the insertion direction of the pin terminal.

The engagement end piece of the resilient contact tongue is formed with a shoulder, and the shoulder engages with the stepped surface to prevent the resilient contact tongue from moving in an insertion direction of the pin terminal.

A second aspect of the present invention is a forming method of a receptacle terminal which includes the steps of:

- forming an electrical wire connection barrel in a rear portion of a base plate strip of the terminal,
- rising a pair of side walls from the base plate strip each at a fore potion of the base plate strip, and
- forming a pair of top walls each extending from each of the side walls so that the base plate strip, the side walls, and the top walls define an electrical contact barrel for receiving a pin terminal,
- accommodating a resilient contact tongue strip having a pair of tabs each laterally projecting from the resilient contact tongue in the electrical contact barrel, the tabs each being inserted into and positioned in an insertion opening formed in each of the side walls of the electrical contact barrel so that the resilient contact tongue is retained in the electrical contact barrel,
- forming an extension, which is forwardly extending from the electrical contact barrel, in the base plate strip,
- providing a groove in the extension such that the groove is extending across a fore open end of the electrical contact barrel,
- overlaying a fore end extended piece of the resilient contact tongue strip on the extension of the base plate strip with the tabs being inserted in the insertion openings, and
- press-cutting the resilient contact tongue strip together with the base plate strip along a line aligned with the fore open end of the electrical contact barrel.

A third aspect of the present invention is a forming method of a receptacle terminal which includes the steps of:

- forming an electrical wire connection barrel in a rear portion of a base plate strip of the terminal, rising a pair of side walls from the base plate strip at a fore potion of the base plate strip, and forming a pair of top walls each extending from each of the side walls so that the base plate strip, the side walls, and the top walls define an electrical contact barrel for receiving a pin terminal, accommodating a resilient contact tongue strip having a pair of tabs each laterally projecting from the resilient contact tongue in the electrical contact barrel, the tabs each being inserted into and positioned in an insertion opening formed in each of the side walls of the electrical contact barrel so that the resilient contact tongue is retained in the electrical contact barrel, forming an extension, which is forwardly extending from the electrical contact barrel, in the base plate strip, providing a groove in the extension such that the groove is extending across a fore open end of the electrical contact barrel, overlaying a fore end extended piece of the resilient contact tongue strip on the extension of the base plate strip with the tabs being inserted in the insertion openings, press-forming at least partially the resilient contact tongue strip along a line aligned with the fore open end of the electrical contact barrel so that a concave is defined in the resilient contact tongue strip due to the groove of the base plate strip, and cutting the resilient contact tongue strip together with the base plate strip along the line aligned with the fore open end of the electrical contact barrel.

Next, operational effects of the invention aspects will be discussed.

The receptacle terminal has the electrical wire connection barrel formed in the rear portion thereof and has the electrical contact barrel in the forward portion thereof. The base plate strip has the fore end extension extending fran the open end of the electrical contact barrel. The extension is preliminarily formed with the groove positioned across the open end of the electrical contact barrel. Meanwhile, the resilient contact tongue strip has the fore end extended piece corresponding to the extension of the base plate strip. With each tab of the resilient contact tongue being inserted in each insertion opening of each side wall of the electrical contact barrel, the extended piece of the resilient contact tongue overlies the extension of the base plate strip. Then, both the resilient contact tongue strip and the base plate strip are cut off together along a line aligned with the fore end of the electrical contact barrel.

Alternatively, with the extended piece of the resilient contact tongue overlying the extension of the base plate strip, the resilient contact tongue strip is press-formed along a line laterally crossing the groove of the base plate strip to form a concave in the extended piece of the resilient contact tongue, and the same cutting process is carried out.

In the second aspect of the invention, the groove is cut to define the stepped surface in the fore end piece of the base plate, while the press-cutting of the resilient contact tongue defines a shoulder formed at the fore end portion thereof and engaging with the stepped surface.

In the third aspect of the invention, with the extended piece of the resilient contact tongue overlying the extension of the base plate strip, the resilient contact tongue strip is press-formed along a line laterally crossing the groove of the base plate strip to form a concave in the extended piece of the resilient contact tongue. After the press-forming, the cutting process is carried out as described above.

Thus produced receptacle terminal has an engagement end piece formed in the fore end piece of the resilient contact tongue, and the fore end piece engages with the stepped surface formed in the fore end portion of the base plate. Therefore, the resilient contact tongue does not move in the insertion direction of the pin terminal when the pin terminal is inserted into the entrance opening of the electrical contact barrel. Thereby, the tab of the resilient contact tongue is prevented from abutting against the periphery of the insertion opening formed in the side wall of the electrical contact barrel. This provides no undesirable restriction on the movement of the resilient contact tongue and eliminates an additional insertion force which might otherwise be required at inserting of the pin terminal.

In the receptacle terminal forming method according to the present invention, the receptacle terminals having such advantages may be produced with a slight modification of a conventional production process and without providing a special forming tool.

DETAILED DESCRIPTION OF THE PREFERRED EMBODIMENTS

Referring to FIGS. 1 to 4, an embodiment of a receptacle terminal and a forming method thereof according to the present invention will be discussed in the following.

Figure 1:
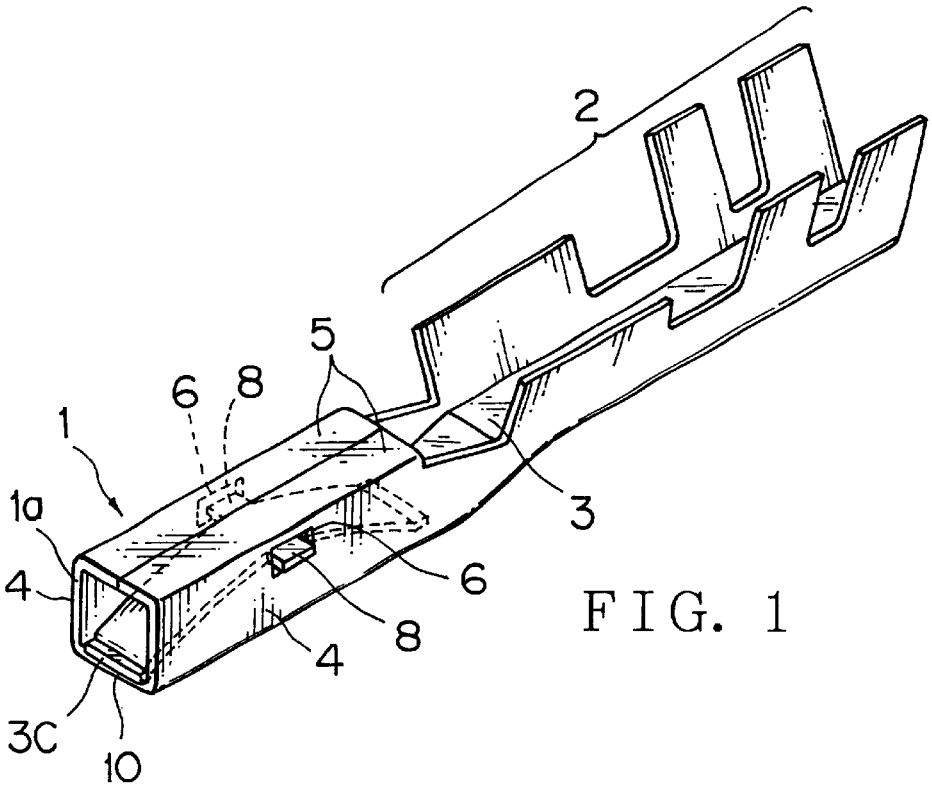
FIG. 1 is a perspective view showing an embodiment of a receptacle terminal according to the present invention.
Figure 2:
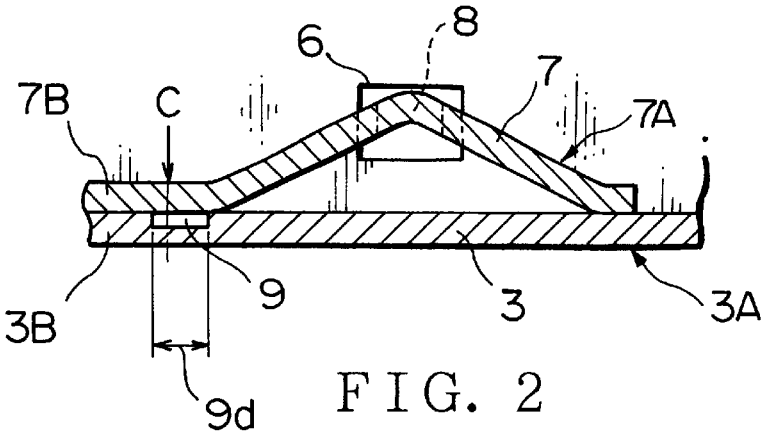
FIG. 2 is a sectional view of a specific part of the receptacle terminal for showing a state in which an resilient contact tongue strip and a base plate strip are arranged before a cutting process of them.

Referring to FIG. 1, the receptacle terminal has a base plate 3, an electrical wire connection barrel 2 positioned at a rear portion of the base plate 3, and an electrical contact barrel 1 positioned at a fore portion of the base plate 3 for receiving an associated pin terminal. The electrical contact barrel 1 is defined in a generally square tubular shape by rising a pair of side walls 4 from the base plate 3 and by inwardly bending the side walls 4 along a line 5*a* to form a pair of top walls 5. The electrical contact barrel accommodates a resilient contact tongue 7 formed with a bend for resiliently contacting the pin terminal. The resilient contact tongue 7 is a separate piece.

Figure 3:
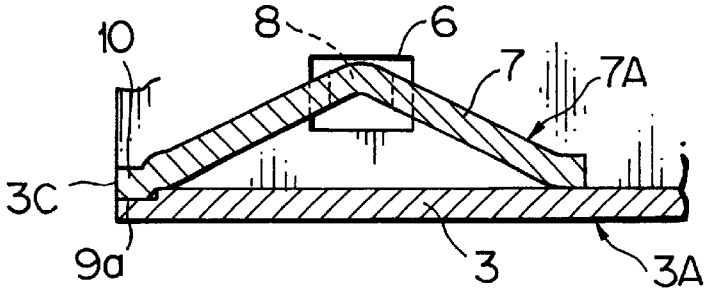
FIG. 3 is a sectional view of the specific part of the receptacle terminal for showing a state in which fore end portions of the resilient contact tongue strip and the base plate strip have been cut away together along a line.

The electrical contact barrel 1 has a pair of tabs 8 each laterally projecting from each side of the resilient contact tongue 7 to hold the contact tongue 7 therein. Each tab 8 is inserted into an insertion opening 6 formed in each side wall 4 of the electrical contact barrel 1 in the same way as the conventional receptacle terminal. However, in the present invention, there is provided a stepped surface 9*a* in a base plate end piece 3*c* positioned at an open periphery 1*a* of the electrical contact barrel 1 as illustrated in FIG. 3. Meanwhile, the end piece of the resilient contact tongue 7 is formed with an engagement end piece 10 engaging at least partially with the stepped surface 9*a*. The engagement of the engagement end piece 10 with the stepped surface 9*a* prevents the resilient contact tongue 7 from moving in the insertion direction of the pin terminal.

In a first forming method of the receptacle terminal according to the present invention, a base plate strip 3A is formed with the electrical wire connection barrel 2 at the rear portion thereof and is formed with the generally square, tubular electrical contact barrel 1. The base plate strip 3A has an extension 3B extending from the open periphery 1*a* of the electrical contact barrel 1. The extension 3B is preliminarily formed with a groove 9 having a width 9*d*. Within the groove width 9*d*, there is positioned a cutting line C generally aligned with the open periphery 1*a* of the electrical contact barrel 1. Meanwhile, a resilient contact tongue strip 7A has an extended piece 7B extending from the fore end thereof as opposed to the extension 3B. With the tabs 8 of the resilient contact tongue 7 being inserted in the insertion openings 6 formed in the side walls of the electrical contact barrel 1, the extended piece 7B of the resilient contact tongue strip 7A overlies the extension 3B of the base plate strip 3A. Then, both the resilient contact tongue strip 7A and the base plate strip 3A are cut together along the cutting line C.

In a second forming method of the receptacle terminal according to the present invention, the extended piece 7B of the resilient contact tongue strip 7A overlies the extension 3B of the base plate strip 3A in the same way as the first forming method. Then, the resilient contact tongue strip 7A is at least partially press-formed against the groove 9 of the base plate strip 3A by means of a press or punching tool. Thereby, the resilient contact tongue strip 7A is formed with a concave that is embossed in the groove 9. Subsequently, both the resilient contact tongue strip 7A and the base plate strip 3A are cut together along the cutting line C.

In the first forming method, cutting the groove 9 along the line C defines the stepped surface 9*a* in the fore end piece of the base plate 3. Furthermore, the cutting process provides a shoulder in the fore end piece of the resilient contact tongue 7 such that the shoulder engages with the stepped surface 9*a*. This provides the engagement end piece 10 engaging with the stepped surface 9*a*.

In the second forming method, press-forming the resilient contact tongue strip 7A against the groove 9 of the base plate strip 3A by means of the press or punching tool defines the concave, which is embossed in the groove 9, in the resilient contact tongue strip 7A. The cutting process along the line C defines the engagement end piece 10 engaging with the stepped surface 9*a*.

Figure 4:
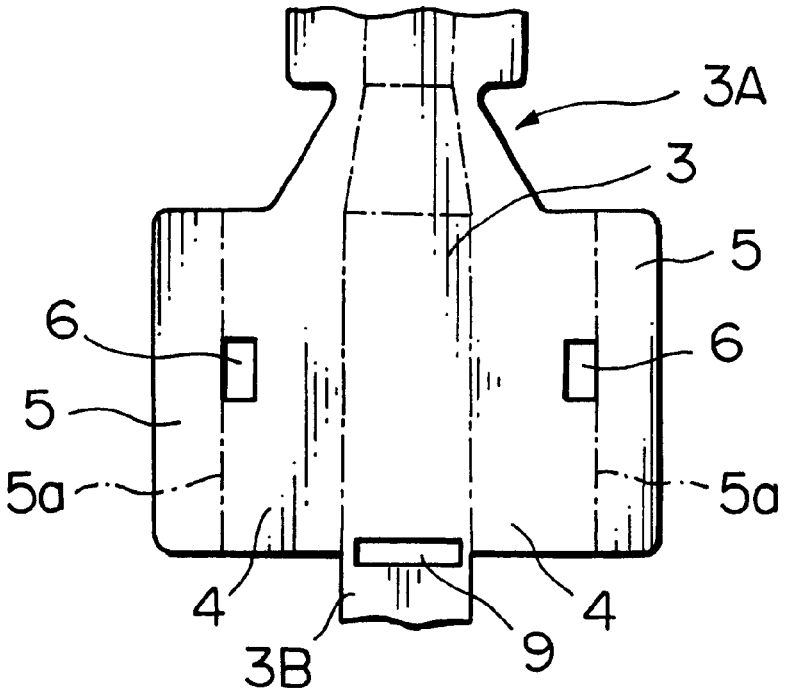
FIG. 4 is a plan view of a partial envelop of the receptacle terminal, which shows the specific part of the receptacle terminal, particularly the arrangement of a groove formed in the base plate strip.
Figure 5:
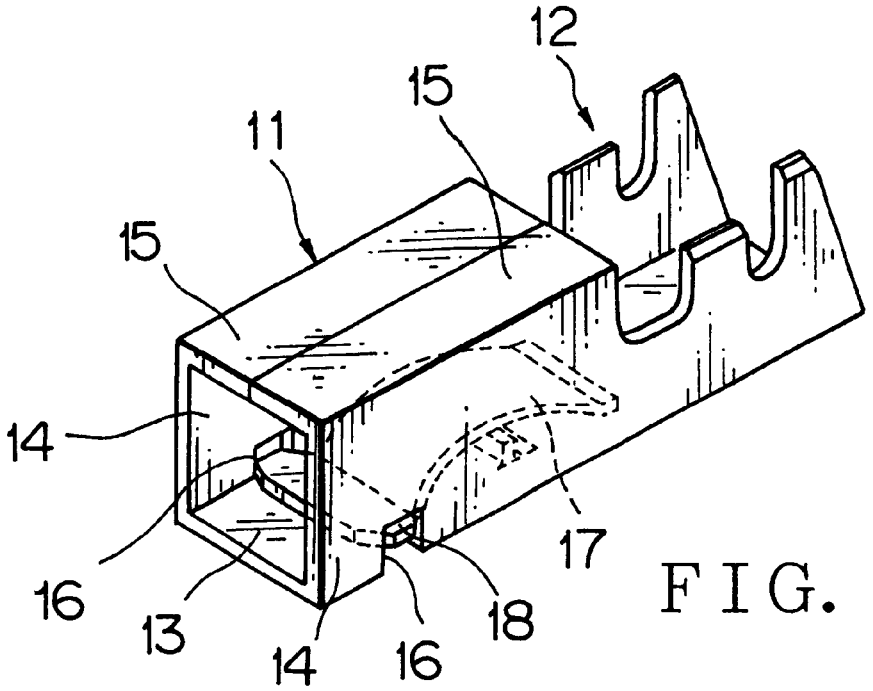
FIG. 5 is a perspective view showing a conventional receptacle terminal.
Figure 6:
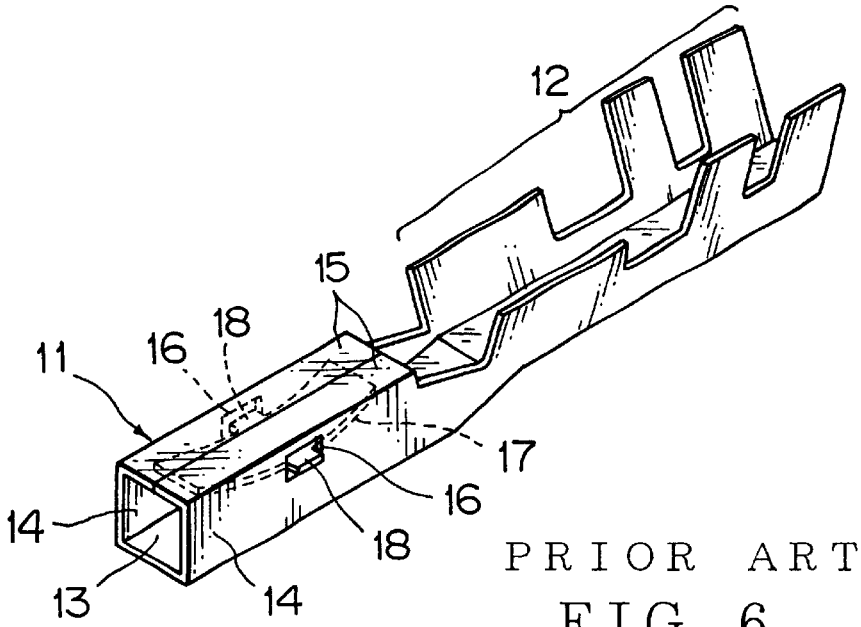
PRIOR ART FIG. 6
FIG. 6 is a perspective view showing a known receptacle terminal which had been proposed by the same applicant of this application.
Figure 7:
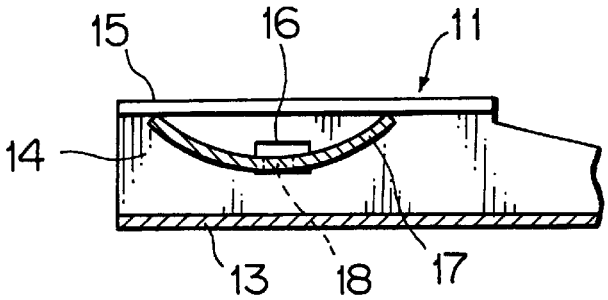
PRIOR ART FIG. 7
FIG. 7 is a sectional view of the known receptacle terminal, which shows a specific part of the terminal that has not received an associated pin terminal.
Figure 8:
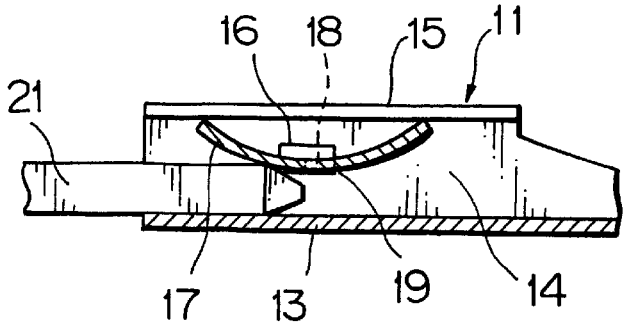
PRIOR ART FIG. 8
FIG. 8 is a sectional view of the known receptacle terminal, which shows the specific part of the terminal that has received the associated pin terminal and illustrates an undesirable state of the terminal.

The groove 9, as illustrated in FIG. 4, is preliminarily formed when the base plate strip 3A is enveloped in a plate. For example, the groove 9 may be formed at the same time when the base plate strip 3A is stamped out from a metal plate. Note that the cutting process along the line C is carried out with ease so that the receptacle terminals may be produced with a slight modification of a conventional production process.

Thus formed receptacle terminal has the engagement end piece 10 formed in the fore end of the resilient contact tongue 7, and the engagement end piece 10 engages with the stepped surface 9*a* formed in the fore end of the base plate 3. Thus, the pin terminal (not shown) inserted from the open end 1*a* of the electrical contact barrel 1 does not move the resilient contact tongue 7 in the pin terminal insertion direction. Accordingly, the tab 8 of the resilient contact tongue 7 is prevented from forcefully abutting against an edge of the insertion opening 6 formed in each side wall of the electrical contact barrel 1. This provides no disadvantageous effects on the resilient movement of the contact tongue 7 and eliminates an additional insertion force which otherwise might be required for the pin terminal.

What is claimed is:

1. A receptacle terminal comprising:

a base plate, an electrical wire connection barrel formed in a rear portion of said base plate, a pair of side walls rising from said base plate at a fore portion of said base plate, and a pair of top walls each extending from each of the side walls, so that said base plate, the side walls, and the top walls define an electrical contact barrel for receiving a pin terminal, said electrical contact barrel accommodating a resilient contact tongue having a pair of tabs each laterally projecting frame said resilient contact tongue, said tabs each being inserted into and positioned in an insertion opening formed in each of the side walls of said electrical contact barrel so that said resilient contact tongue is retained in said electrical contact barrel, wherein said electrical contact barrel has a stepped surface formed on an end piece of said base plate at an open end of said electrical contact barrel, and said resilient contact tongue has an engagement end piece at least partially engaging with said stepped surface to prevent said resilient contact tongue from moving in an insertion direction of the pin terminal.

2. The receptacle terminal set forth in claim 1, wherein said engagement end piece of said resilient contact tongue is formed with a shoulder, and the shoulder engages with said stepped surface to prevent said resilient contact tongue from moving in said insertion direction of the pin terminal.

* * * * *